United States Patent [19]

Freis et al.

[11] 4,456,397

[45] Jun. 26, 1984

[54] ROAD INSPECTION MANHOLE

[75] Inventors: Jean L. Freis, Saint Nicolas du Port; Jean C. Hauer, Saulxures les Nancy; Jacques Oger, Pont-A-Mousson, all of France

[73] Assignee: Centre de Recherches de Pont A Mousson, Pont A Mousson, France

[21] Appl. No.: 384,704

[22] Filed: Jun. 3, 1982

[30] Foreign Application Priority Data

Sep. 23, 1981 [FR] France ..... 81 17906

[51] Int. Cl.[3] ..... E02D 29/14

[52] U.S. Cl. ..... 404/25; 52/19

[58] Field of Search ..... 404/25, 26, 2, 4, 5; 52/19, 20, 21; 137/371; 210/163, 164, 165, 166

[56] References Cited

U.S. PATENT DOCUMENTS

| | | | |
|---|---|---|---|
| 275,785 | 4/1883 | Omensetter | 404/26 |
| 1,239,704 | 9/1917 | Lee et al. | 137/371 X |
| 4,015,373 | 4/1977 | Boissier | 404/25 X |
| 4,203,686 | 5/1980 | Bowman | 404/25 |

FOREIGN PATENT DOCUMENTS

| | | | |
|---|---|---|---|
| 391917 | 5/1933 | United Kingdom | 404/25 |
| 482517 | 3/1938 | United Kingdom | 404/25 |
| 492190 | 9/1938 | United Kingdom | 404/25 |

*Primary Examiner*—James A. Leppink
*Assistant Examiner*—Beverly E. Hjorth
*Attorney, Agent, or Firm*—Sughrue, Mion, Zinn, Macpeak and Seas

[57] ABSTRACT

The manhole has a frame 1 with a flange 4 to be embedded in the road and a movable cover 2 to fit in the cylindrical wall 3 of the frame. On its inside the wall 3 has three support surfaces 9 each downwardly sloping at an angle $\alpha$ to the horizontal in the circumferential direction and at an angle $\beta$ to the horizontal in the radial direction. Between the surfaces 9 the frame has three undercut surfaces 11 extending radially. On its underside the cover 2 has six surfaces 14, 15. When the cover is on the frame three surfaces 14 are parallel to the corresponding surfaces 9 and the three surfaces 15 are parallel to the corresponding surfaces 11. The surfaces 9, 11 on the frame abut the surfaces 14, 15 by which the cover is held against rocking.

25 Claims, 14 Drawing Figures

ROAD INSPECTION MANHOLE

This invention concerns a road inspection manhole or similar device of a type comprising a frame to be embedded in a road covering, and a movable cover which works in conjunction with the frame.

An object of the invention is to provide a manhole which, even if the cover and frame are rough cast, provides good stability of the cover under the effect of loads travelling thereover, that is, the chance of the cover rocking is eliminated or at least considerably reduced.

According to the invention there is provided a road inspection manhole or similar device comprising a frame to be embedded into a road covering, a movable cover which works in conjunction with the frame, the frame having on its periphery three support surfaces with a double slope extending downwardly in the circumferential and radial directions, and, between these three surfaces, the frame having three counter support surfaces, and the cover having six surfaces which are respectively parallel to said six surfaces of the frame and are provided to work in conjunction with the six surfaces of the frame.

In preferably both the radial direction and the circumferential direction, each support surface forms with the horizontal surface an angle included between the angle of friction of the cooperating surfaces of the frame and of the cover and the complement of this angle. Hence an automatic closing and an automatic centering of the cover are obtained by simple gravity when the support surfaces of the latter are placed on those of the frame.

If, moreover, the counter support surfaces of the frame slope downwards in an overhanging manner, the cover is locked, that is, it cannot lift up inopportunely under the effect of stresses applied to it during operations outside the supporting triangle defined by the three support points.

It is desirable from the point of view of distribution of stresses that the six surfaces are distributed in a regular manner on the periphery of the frame and of the cover. In fact, when a stress is exerted on the outside of the supporting triangle, the approximately identical angular displacement between the alternate support surfaces and counter support surfaces leads to the existence of two more or less symmetrical anti-rocking devices, so that the stresses are limited within the material.

In one variant which is easy to cast, the support and countersupport surfaces consist of plane facets. However, if the rotational movements carried out by the cover as it is put into position is taken into account, as well as the manufacturing tolerances encountered in cast components or use on the highway, this often leads, in practice, to observing only quasipoint contacts between the active surfaces of the cover and those of the frame, even after hammering which takes place in operation under the effect of travelling loads.

This is why, in another embodiment which ensures a much better utilisation of the active surfaces of the frame and of the cover, especially when these are rough cast, the support surfaces and/or counter-support surfaces are skew surfaces of helicoidal appearance. This characteristic makes it possible to obtain contacts which are linear at the very least and are transformed after hammering into surface contacts.

In this case the said skew surfaces can each have a linear transverse cross section. In a modification which improves the automatic positioning of the cover, the support surfaces have a curvilinear transverse cross section, those of one of the two element of the inspection manhole being concave, and having a radius of curvature greater than those, which are convex, of the other element, at least in the regions of these support surfaces, which work in conjunction with one another.

The invention will now be further described, by way of example, with reference to the accompanying drawings in which.

Figure 12:
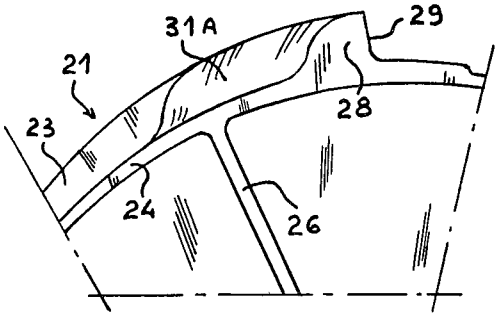
Figure 13:
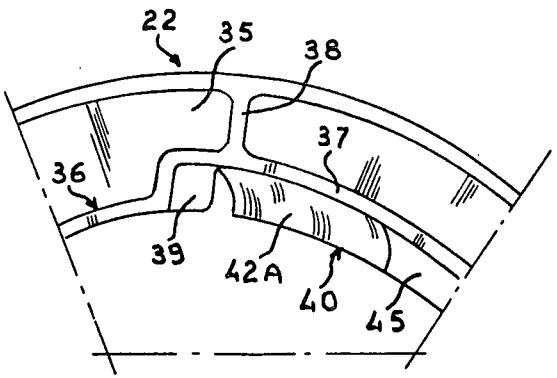
Figure 10:
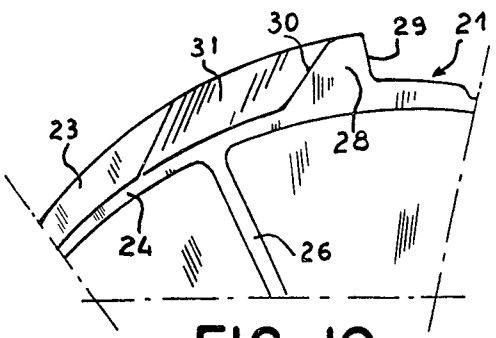
FIG. 10 is a view of a fragment of the underneath of the cover in FIG. 8.
Figure 11:
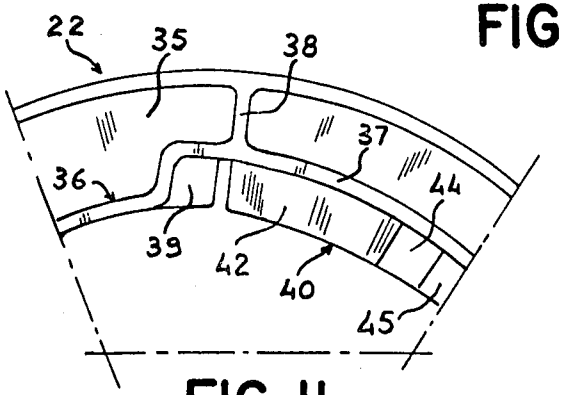
FIG. 11 is a fragmentary view of the top of the frame in FIG. 8.

FIGS. 12 and 13 are views similar to FIGS. 10 and 11 respectively, illustrating a modification of the inspection manhole in FIGS. 8 to 11, and FIG. 14 is a diagram of a detail of modification of the inspection manhole in FIGS. 12 and 13.

Figure 1:
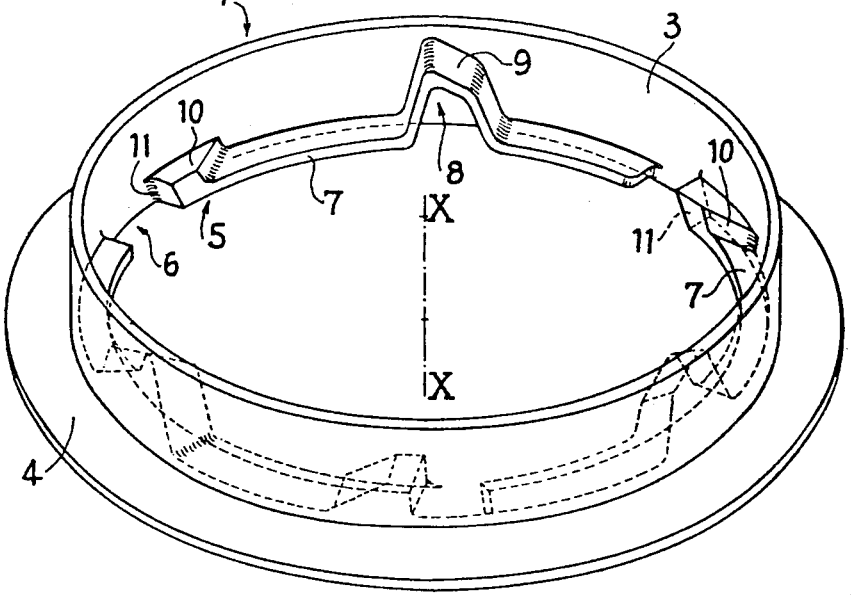
FIG. 1 is a perspective view of the frame of an embodiment of inspection manhole formed according to the invention.
Figure 2:
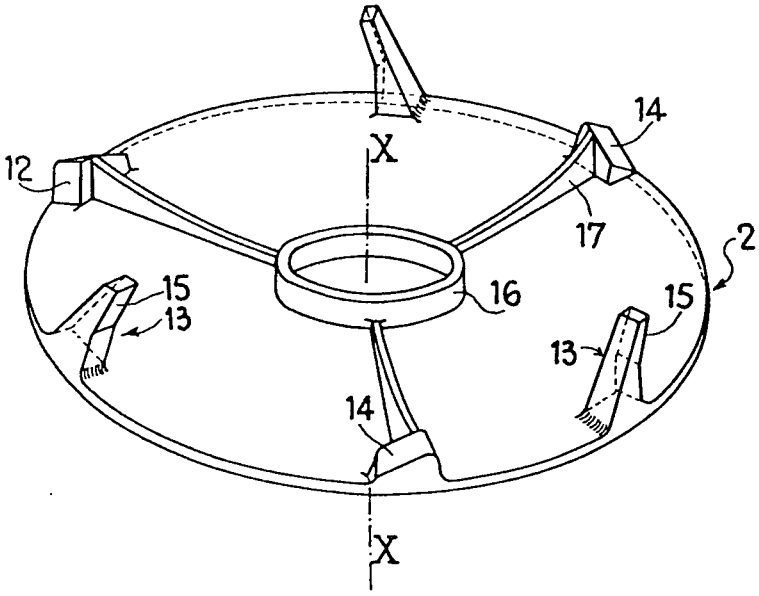
FIG. 2 is a perspective view of a cover to be used in conjunction with the frame in FIG. 1, the cover being shown as having been turned upside down and placed on the ground.

The inspection manhole shown in FIGS. 1 and 2 consist of two components, namely, a frame 1 and a closing lid or cover 2, and both, for example, can be made by rough castings.

The purpose of the frame 1 is to be embedded into the road covering at the upper end of a shaft or cylindrical chimney (not shown). The frame has a cylindrical wall 3 with vertical axis X—X. From the lower end of the wall 3 a horizontal support flange 4 extends outwardly and a collar 5 extends inwardly.

The collar 5 is interrupted at three places 6 which are spaced at an angle of substantially 120° from one another in such a manner as to define three sectors 7. In the middle of its length each sector 7 extends upwards and forms a projection 8 forming three sides of a quadrilateral, the upper side forming a plane support facet 9 which slopes both in the radial direction downwards starting from the wall 3, and in the circumferential direction downwards in a clockwise direction in FIG. 1. Moreover, the upstream end, in relation to the clockwise direction, of each sector 7 forms an excess thickness 10 whose upstream end face forms a plane facet which acts as a stop or counter support 11 which slopes downwards in an undercut or overhanging manner and, in plan view, is directed radially.

The facets 11 are displaced circumferentially by substantially 60° in relation to the facets 9 and are situated entirely below the facets 9.

The cover 2 is a circular disc whose diameter is slightly less than the internal diameter of the cylindrical wall 3. Its upper face has anti-skid patterns in relief (not shown) and its lower face has 6 peripheral projections and stiffening ribbing.

The projections of the cover comprise three blocks 12 and three projections 13 which are substantially vertical and of elongated shape, spaced alternately every 60° around the cover. In the operating position of the cover, each block 12 has a lower support surface 14 which is parallel to a respective facet 9, that is, with double slopes, and each projection 13 has at its end, on one side, a radial surface acting as a stop or counter support surface 15 parallel to a respective facet 11. The stiffening ribbing comprises a central cylindrical collar 16, and three ribs 17 extending from the collar towards the blocks 12.

Figure 3:
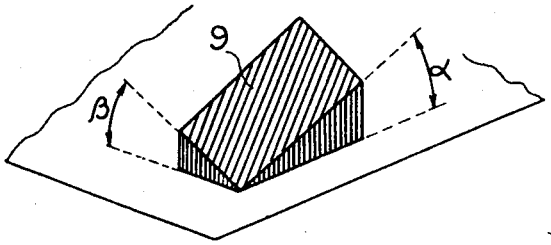
FIG. 3 is a diagram of a detail to illustrate the principle to which the frame in FIG. 1 conforms.
Figure 4:
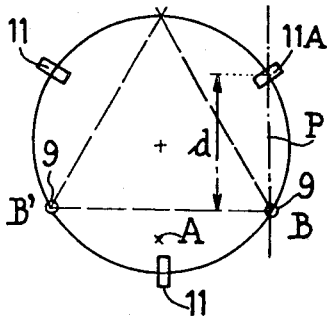
FIG. 4 is a diagrammatic illustration in plan view of the frame.
Figure 5:
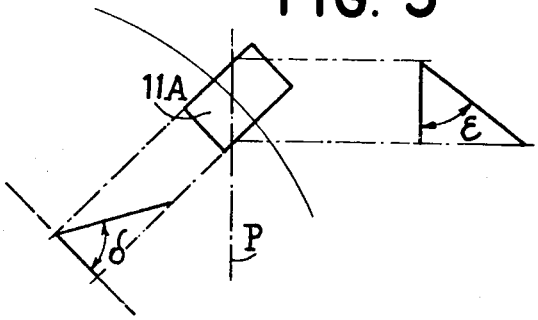
FIG. 5 shows a detail of FIG. 4 on a larger scale.

FIG. 3 shows the double slope of the facet 9; a slope $\alpha$ to the horizontal in the circumferential direction and a slope $\beta$ to the horizontal in the radial direction. Similarly FIG. 5 shows the slope $\delta$ to the horizontal of a facet 11A and the angle $\epsilon$ which is formed by this facet 11A with the horizontal in a plane with a cross section P which is perpendicular to a rocking axis B'—B (FIG. 4) extending from the support 9 opposite the facet 11A to another said support 9.

If $\psi$ designates the coefficient of friction of the surfaces 14 and 15 on the facets 9 and 11, the following conditions are fulfilled:

$$\psi<\alpha<90°-\psi \quad (1)$$

$$\psi<\beta<90°-\psi \quad (2)$$

$$\epsilon>\alpha+2\psi \quad (3)$$

FIGS. 3 and 5 and the relationships (1) to (3) apply likewise to the surfaces 14 and 15, respectively, of the cover 2. As an example, for cast components, it is possible to have $\psi=20°$ and $\alpha$ and $\beta$ of the order of 30° to 45°.

When the cover is put in position, it is arranged coaxially with the wall 3 of the frame in such a manner that the surfaces 14 are approximately straight above the facets 9, the projections 13 being inserted freely into the interruptions 6 of the collar 5. By means of the condition (1) above, the cover descends of its own accord rotating around its axis, by simple gravity; owing to the condition (2) an automatic centering of the cover is achieved during this descent.

Figure 6:
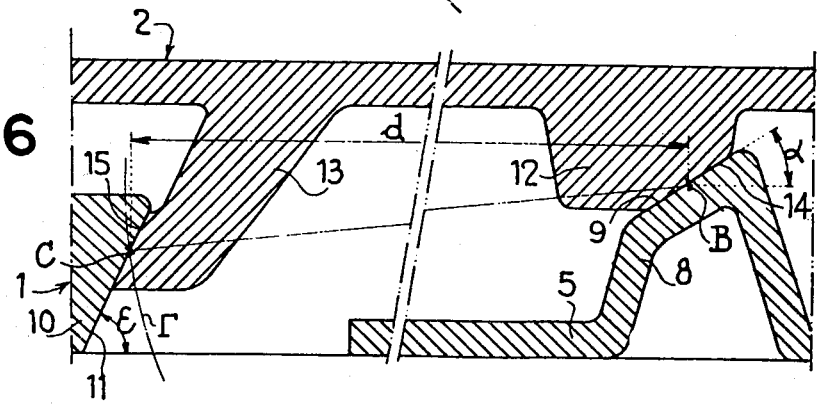
FIG. 6 is a developed cross section diagram illustrating the principle governing cooperation between the frame and cover showing the circumference of the inspection chamber manhole with exaggeration of certain parts in the interests of clarity.

The descent of the cover stops when its surfaces 15 come into contact with the stopping facets 11 of the frame, as shown in FIG. 6. In this position, the cover is perfectly stable and cannot rock.

If a force is applied within the support triangle defined by the three facets 9, it is balanced by the simple reaction of these facets. It is to be noted that owing to the presence of the angle $\beta$, the cover is supported on the three facets 9 which, by means of tilting, procure an arch effect which makes a lighter geometry of the cover possible.

If the force is applied outside the support triangle (for example at point A in FIG. 4) the cover is stressed by a rocking force exerted about the horizontal axis defined by the two adjacent supports 9. However, if the distance in horizontal projection from this axis to the two stops 11 opposite the point A is designated by d this distance d, the difference in level h between the centres B of the support facets 9 and those C of the stop facets 11, and the angle $\epsilon$ are chosen in such a manner that in the plane P which is that of FIG. 6, the circle $\Gamma$ centered at B and passing through C, clearly cuts through the upper part of the stop facet 11 (FIG. 6). This ensures a sufficient retention of the cover against rocking. The relationship (3) indicated above makes it possible to avoid any wedging in this position.

Hence the cover is perfectly stable. If, moreover, $\epsilon<90°$ (facets 11 overhanging), as in the example under consideration, the cover is likewise locked, that is, it can only be lifted by a voluntary intervention turning it in the counterclockwise direction. The cover is thus automatically closing, automatically centering, automatically locking and supported in the manner of an arch.

Figure 7:
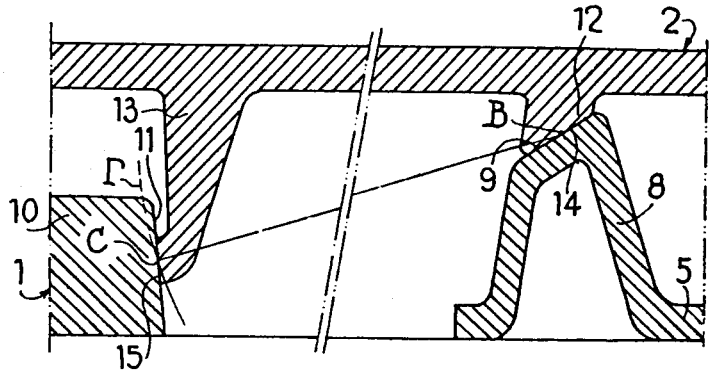
FIG. 7 is a view similar to FIG. 6 of a modification of the inspection manhole shown in FIGS. 1 to 6.
Figure 9:
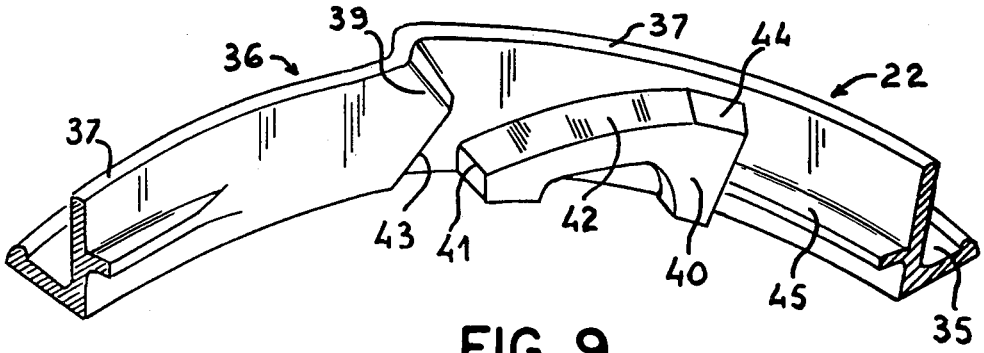
FIG. 9 is a fragmentary perspective view of the frame to cooperate with the cover in FIG. 8.
Figure 8:
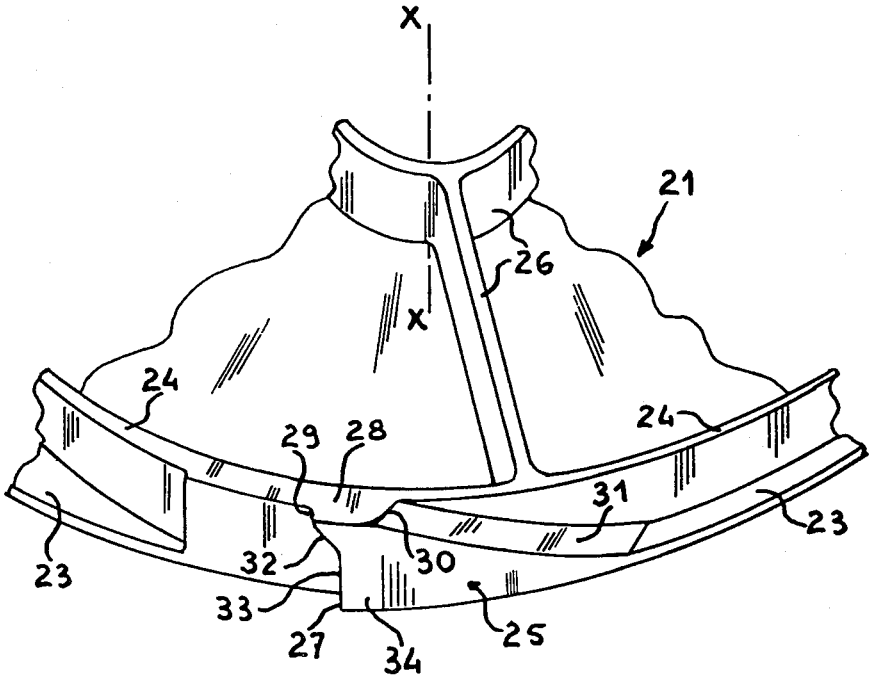
FIG. 8 is a fragmentary perspective view of a cover of another embodiment of an inspection manhole formed according to the invention, the cover being shown turned upside down and placed flat on the ground.

However, if locking is not desired, it is possible to retain the other characteristics of the cover by imparting to the angle $\epsilon$ a value equal to or greater than 90°, as shown in FIG. 7, provided that the other conditions described above are retained. Only the weight of the cover and friction forces then resist its vertical extraction, and the facets 11 solely undertake the functions of a stop and an antirocking arrangement.

In practice the contacts 14-9 and 15-11 are in the first place point contacts, but a hammering of the metal takes place until the contact surfaces become sufficient to support the forces. The conditions indicated above concern the definitive position of the cover, after hammering. It is moreover possible to contemplate providing harder active facets 9 and 11 on the frame (by using a different material or by means of heat treatment) in order to limit the hammering on the active surfaces 14 and 15 of the cover and to avoid any risk of inlaying these surfaces in the facets 9 and 11, or conversely.

Moreover, the cover never descends perfectly coaxially to the frame. In fact, a first surface 15 meets the first associated facet 11, which becomes the centre of rotation, then a second surface 15 does the same. The cover can then either continue to be displaced towards the third contact 15-11, or else become immobilised in this pre-equilibrium position, with only five points of contact. In this case, the first loads travelling over the cover and applied eccentrically thereto will make the cover slide further until the sixth point of contact 15-11 is obtained.

In a modification, a slight circumferential dissymmetry of the support and/or stopping surfaces can be provided in the horizontal plane, for example the three angular spacings can be 118°, 118° and 124°, in order to have a single position for placing the cover on the frame, and, consequently, always preserve the same matching of the contact surfaces. In this case, it is useful to provide the cover and the frame with an angular positioning marker in order to facilitate the task of the operator.

In a further modification, the cover can have a different general shape from that of a disc; it can, for example, include an upper flat core and a peripheral downwardly directed skirt. Moreover, the six projections 12 and 13 of this cover can likewise be formed as an external radial projection.

The invention, of course, can likewise be applied to gulley holes or any other closing device for underground inspection or access.

The road inspection manhole shown in FIGS. 8 to 11 consists of two rough cast ductile elements, that is, a movable lid or cover 21 and a frame 22 the purpose of which is to be fastened into the road surface and to be closed by the cover 21. Each of these elements 21 and 22 has a ternary symmetry about a common vertical axis X—X, that is, a repetition of similar points every 120° about the axis X—X.

The cover 21 comprises an upper horizontal eccentricity 23 and a peripheral vertical skirt 24 provided with three external reliefs 25 and radial and central sitffening lower ribs 26.

The eccentricity 23 is flat, relatively thin and of more or less circular shape. However, on each sector of 120°, its radius increases slightly and ends in a radial side 27 which connects this sector with the root of the following sector. The upper face of the eccentricity 23 consists of anti-skid patterns in relief (not shown).

The skirt 24 goes towards the bottom of the lower face of the eccentricity 23. It is cylindrical and approximately tangential to the circle of minimum radius of the eccentricity 23.

Each relief 25 is formed of a block whose lateral cross section is in the form of an evolutive curvilinear rectangular trapezium. The lower face 28 of this relief which is co-planar with that of the skirt 24 (FIGS. 8 and 10), includes in particular a radial front side 29 and a sloping rear side 30. The direction of the side 30 varies from the face 28 to the lower face of the eccentricity 23 to form a helicoidal support surface 31. The side 29 remains radial and generates, from the face 28 to about half way up the skirt 24, a helicoidal counter-support surface 32 turned upwards. This surface 32 is extended upwards, up to the upper face of the eccentricity 23, by a flat facet 33 which is vertical and radial and approximately rectangular. The upper side of the facet 33 is formed by the side 27 of the associated sector of the eccentricity 23.

The relief 25 has in addition a peripheral face 34 with vertical generatrices following the external contour of the eccentricity 23.

Actually the surfaces described as vertical in this description are slightly sloping to form a hollowed out angle to make removal from the mould easier.

The frame 22 includes a flat lower support flange 35 of annular shape from the internal periphery of which a cylindrical ring 36 ascends. This ring has the same shape in plan as the eccentricities 23 of the cover, that is it is circular with three excrescences 37, its internal radius at each point being slightly greater than the external radius of a corresponding point of the eccentricity 23. Vertical stiffening ribs 38 connect the ring 36 to the flange 35.

The ring 36 has a uniform thickness over its whole periphery except at the root of each of its excrescences 37, where the ring is extended inside into a point 39 of excess thickness in the cavity defined by the following excrescence. Moreover, a block 40 projects into this cavity defining a second point 41 situated more or less opposite the end 39 but shifted in the circumferential direction and towards the bottom in relation to the end 39.

More precisely, from the side of the end 39, the block 40 has a helicoidal upper face 42 which forms a ramp or support surface combined with a support surface 31 of the cover, while the lower face 43 of the end 39 is helicoidal and forms a ramp or counter-support surface combined with a counter-support surface 32 of the cover.

The block 40 has an upper flat and horizontal surface 44 situated below the upper rim of the ring 36 by a distance which is greater than the total thickness of the eccentricity 23 with its anti-skid reliefs.

Finally, half way up the ring 39, a horizontal internal rib 45 is provided, starting from the end of each block 40 opposite its end 41 and of decreasing width.

The general shape of the frame 22 and especially of the ends 39 and 41 is such that this frame can be moulded without a core like the cover 21, in such a manner that the whole of the inspection manhole 21, 22, is very economical to make on an industrial scale.

In use, the frame 22 is embedded into the road covering and is flush with the surface of the latter. In order to put the cover 21 into position, the base of the surfaces 31 of the cover is placed on the surfaces 42 of the frame. A slight pushing in the screwing direction is then sufficient to make the cover descend helicoidally following the axis X—X under the effects of its own weight.

During the course of this movement, the faces 31 slide on the ramps 42, and the reliefs 25 penetrate under the ends 39, until the faces 32 come into contact with the faces 43. There is then a double contact 31-42 and 32-43. Owing to the helicoidal shape of these surfaces, six contacts which are at least linear are obtained in a safe manner and these become surface contacts after the hammering of the metal which takes place in operation under the effect of travelling loads.

Hence this inspection manhole differs from the one described in FIGS. 1–7 in two aspects:

(i) the support and counters-support surfaces are helicoidal with the advantage indicated above, and (ii) each counter support surface is close, in the circumferential direction, to the associated support surface with a view to simplifying casting. Apart from these differences, the inspection manhole of FIGS. 8–11 has the same characteristics as that of FIGS. 1–7.

The modification in FIGS. 12 and 13 differs from that of FIGS. 8 to 11 only in the shape of the generatrices of the support surfaces 31A and 42A which makes a better automatic positioning of the cover possible. These generatrices are in fact arcs of a circle, convex for the surfaces 31A and concave for the surfaces 42A. Along each surface the arc has constant radius, the radius R of the surfaces 42A being greater than the radius r of the surfaces 31A.

Figure 14:
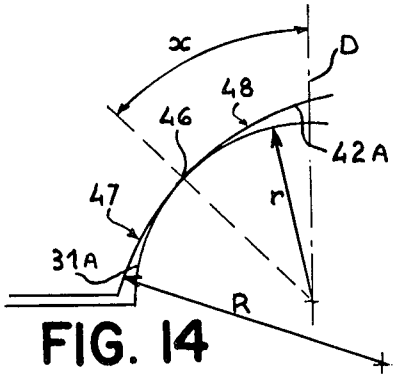

The cover comes into position of its own accord in the frame in the same manner as previously. In each section, the three contacts 31A–42A take place at the points of contact 46 of the associated quadrants of circles (FIG. 14). The angle x formed by the normal to the two quadrants in contact at the point 46 and the radial direction D of the cover passing through the center of the quadrant of the circle of radius r under consideration is at the maximum equal to 60° and preferably, as shown, equal to 45°.

The cover is thus in initial contact with the frame following at least six helicoidal curved lines, as previously, and experience shows that the support lines passing through the points 46 are relatively well defined and are only decreased a little, for example, on the arc 47–48 of FIG. 14 centered on the point 46, on recentering of the cover which takes place in operation under the effect of the travelling loads.

In a modification, the form of the generatrices of the support surfaces 31A and 42A could be in horizontal cross-section a curve which differs by quarter of a circle.

In each of the two embodiments, the double slope is found towards the bottom of the support surfaces or of their tangent planes at the points of contact, described with reference to FIGS. 1 to 7 with the same considerations relating to the angles and the stability of the cover.

I claim:

1. A manhole, comprising:

a frame (1; 22) embedded into a surface covering, said frame having on its periphery three first support surfaces (9; 42; 42A) with a double slope extending downwardly in a circumferential direction and downwardly in a radial direction toward a center axis (X—X) of said frame, and, between these three surfaces, said frame having three second support surfaces (11; 43; 43);

a movable cover (2; 21) insertable into said frame, said cover having six surfaces (14, 15; 31, 32, 31A, 32) complimentary to said six surfaces of said frame which engage with said six surfaces of the frame when said cover is inserted into said frame.

2. A manhole as claimed in claim 1, said manhole comprising a road inspection manhole, and said surface covering comprising a road surface covering.

3. A manhole as claimed in claim 1, said second surfaces and said surfaces complimentary thereto being situated entirely below said first support surfaces and said surfaces complimentary thereto, respectively.

4. A manhole as claimed in claim 3, said frame and said cover being formed such that a circle (∇) having its center on a rocking axis (B—B′) passing through two of said first support surfaces and which circle passes through a center (C) of one of said complimentary second support surfaces also passes through an upper part (10) of said second support surface of said frame engaged with said one of said complimentary second support surfaces.

5. A manhole as claimed in claim 1, said frame and said cover being formed such that a circle (∇) having its center on a rocking axis (B—B′) passing through two of said first support surfaces and which circle passes through a center (C) of one of said complimentary second support surfaces also passes through an upper part (10) of said second support surface of said frame engaged with said one of said complimentary second support surfaces.

6. A manhole as claimed in claim 1, each first support surface and surface complimentary thereto being sloped downwardly in said radial direction so as to form a first angle ($\beta$) with a horizontal radial line of said frame, and said first angle having a value between a friction angle ($\Psi$) of said each first support surface plus said surface complimentary thereto and a compliment of said friction angle.

7. A manhole as claimed in claim 1, each first support surface and surface complimentary thereto being sloped downwardly in said circumferential direction so as to form a first angle ($\alpha$) with a horizontal line which is perpendicular to a horizontal radial line of said frame, said first angle having a value between a friction angle ($\Psi$) of each said first support surface plus said surface complimentary thereto and a compliment of said friction angle.

8. A manhole as claimed in claim 1, said second support surfaces sloping downwards in an overhanging manner so as to face downwardly relative to a plane of said surface covering.

9. A manhole as claimed in claim 8, each second support surface and said surfaces complimentary thereto being sloped so as to form a first angle ($\epsilon$), relative to a horizontal line in a plane (P) perpendicular to a rocking axes (B—B′) passing through two of said first support surfaces, which is greater than a circumferential slope angle ($\alpha$) of said first support surfaces increased by twice an angle of friction ($\Psi$) of said each second support surface and said surface complimentary thereto.

10. A manhole as claimed in claim 1, said second support surfaces sloping downwardly so as to face upwardly relative to a plane of said surface covering.

11. A manhole as claimed in claim 10, each second support surface and said surfaces complimentary thereto being sloped so as to form a first angle ($\epsilon$), relative to a horizontal line in a plane (P) perpendicular to a rocking axes (B—B′) passing through two of said first support surfaces, which is greater than a circumferential slope angle ($\alpha$) of said first support surfaces increased by twice an angle of friction ($\Psi$) of said each second support surface and said surface complimentary thereto.

12. A manhole as claimed in claim 1, said three second support surfaces being shifted by 60 degrees in a circumferential direction relative to said first three support surfaces.

13. A manhole as claimed in claim 1, said six surfaces of said frame and said cover being regularly and uniformly distributed over the periphery of said frame and said cover, respectively.

14. A manhole as claimed in claim 1, said six surfaces of said frame and said cover being distributed in a near uniform manner over a periphery of said frame and said cover, respectively, while displaying a slight dissymmetry about an axes (X—X) of said manhole, said cover and said frame each having an angle positioning marker.

15. A manhole as claimed in claim 1, said six support surfaces of said frame having a hardness different from a hardness of respective complimentary surfaces of said cover.

16. A manhole as claimed in claim 1, said first support surfaces (42; 42A) and said surfaces complimentary thereto (31; 31A) being skew surfaces of helicoidal form.

17. A manhole as claimed in claim 16, said skew surfaces (31; 42) each having a rectilinear transverse cross section (29, 30).

18. A manhole as claimed in claim 17, each second support surface (43) and said surface (32) complimentary thereto of said frame and said cover, respectively being close, in a circumferential direction, to an associated first support surface and surface complimentary thereto (31, 42; 31A, 42A).

19. A manhole as claimed in claim 16, said first support surfaces (42A) and said surfaces complimentary thereto (31A) having a curvilinear transverse cross section, said first support surfaces of said frame being concave and said surfaces complimentary thereto on said cover being convexed, a radius of curvature (R) of said first support surfaces being greater than a radius of curvature (r) of said surfaces complimentary thereto at least in engaging areas (47, 48) of these support surfaces.

20. A manhole as claimed in claim 19, said curvilinear cross section being within a quarter of a circle.

21. A manhole as claimed in claim 20, each second support surface (43) and said surface (32) complimentary thereto of said frame and said cover, respectively being close, in a circumferential direction, to an associated first support surface and surface complimentary thereto (31, 42; 31A, 42A).

22. A manhole as claimed in claim 19, each second support surface (43) and said surface (32) complimentary thereto of said frame and said cover, respectively being close, in a circumferential direction, to an associated first support surface and surface complimentary thereto (31, 42; 31A, 42A).

23. A manhole as claimed in claim 16, said first support surfaces (42A) and said surfaces complimentary thereto (31A) having curvilinear transverse cross sections, said first support surfaces of said frame being concave and said surfaces complimentary thereto on said cover being convex, a radius of curvature (R) of said first support surfaces being equal to a radius of curvature (r) of said surfaces complimentary thereto which are convex at least in engaging areas (47, 48) of these support surfaces.

24. A manhole as claimed in claim 23, each second support surface (43) and said surface (32) complimentary thereto of said frame and said cover, respectively being close, in a circumferential direction, to an associated first support surface and surface complimentary thereto (31, 42; 31A, 42A).

25. A manhole as claimed in claim 16, each second support surface (43) and said surface (32) complimentary thereto of said frame and said cover, respectively being close, in a circumferential direction, to an associated first support surface and surface complimentary thereto (31, 42; 31A, 42A).

* * * * *